US008264416B2

(12) United States Patent
Maniwa et al.

(10) Patent No.: US 8,264,416 B2
(45) Date of Patent: Sep. 11, 2012

(54) APERTURE ANTENNA

(75) Inventors: Toru Maniwa, Kawasaki (JP); Andrey Andrenko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 550 days.

(21) Appl. No.: 12/458,283

(22) Filed: Jul. 7, 2009

(65) Prior Publication Data

US 2010/0073249 A1 Mar. 25, 2010

(30) Foreign Application Priority Data

Sep. 24, 2008 (JP) ..... 2008-244616

(51) Int. Cl.
*H01Q 13/00* (2006.01)

(52) U.S. Cl. ..... 343/772; 343/791

(58) Field of Classification Search ..... 343/771, 343/772, 786, 790, 791
See application file for complete search history.

(56) References Cited

U.S. PATENT DOCUMENTS

| | | | | |
|---|---|---|---|---|
| 6,211,750 | B1 * | 4/2001 | Gould | 333/21 A |
| 7,998,139 | B2 * | 8/2011 | Rossetto et al. | 606/33 |
| 8,059,059 | B2 * | 11/2011 | Bonn | 343/872 |
| 2003/0187366 | A1 | 10/2003 | Hashimshony | |
| 2008/0021343 | A1 | 1/2008 | Hashimshony | |

FOREIGN PATENT DOCUMENTS

| | | |
|---|---|---|
| JP | 11-284428 | 10/1999 |
| JP | 2004-266268 | 9/2004 |

OTHER PUBLICATIONS

Japanese Office Action dated Mar. 6, 2012 issued in corresponding Japanese Patent Application No. 2008-244616.

* cited by examiner

*Primary Examiner* — Tan Ho
(74) *Attorney, Agent, or Firm* — Staas & Halsey LLP

(57) ABSTRACT

An aperture antenna includes an outer conductor with substantially fixed inner diameter; and an inner conductor, an end thereof receding from an aperture of the outer conductor in a direction of electromagnetic radiation.

18 Claims, 15 Drawing Sheets

NEIGHBORHOOD DISTRIBUTION OF ELECTRIC FIELD

APERTURE ANTENNA

CROSS-REFERENCE TO RELATED APPLICATIONS

This application is based upon and claims the benefit of priority of the prior Japanese Patent Application No. 2008-244616, filed on Sep. 24, 2008, the entire contents of which are incorporated herein by reference.

FIELD

The embodiments discussed herein are related to an aperture antenna.

BACKGROUND

An aperture antenna such as a horn antenna has a waveguide portion with its cut-off wavelength being smaller than that of outgoing electromagnetic wave and a flare portion with its diameter being enlarged as approaching an aperture for impedance matching with space.

FIG. 1 depicts a conventional horn antenna 11. The conical horn antenna 11 has a circular waveguide 12, a flared conical portion 13 connected to the circular waveguide 12, and an oscillation source 15 to supply power. The circular waveguide 12 has a cut-off wavelength of 3.41A/2 in TE11 mode, where "A" being the inner diameter of the circular waveguide 12. Any electromagnetic wave with shorter wavelength than the cut-off wavelength does not pass through the circular waveguide 12. Assuming that an outgoing electromagnetic wave has a wavelength lambda, the inner diameter "A" of the circular waveguide must be greater than 2*lambda/3.41, or A>=2*lambda/3.41. The flared conical portion 13 connected to the circular waveguide 12 has inner diameter enlarged as approaching the aperture 14, with the inner diameter at the aperture 14 being approximately lambda. This matches the impedance of the antenna with that of space.

FIG. 2 depicts another conventional horn antenna 21. The conical horn antenna 21 illustrated in FIG. 2 has a metal coaxial line 26 as well as a circular waveguide 22 and a flared conical portion 23 which are similar to those of the conical horn antenna 11 illustrated in FIG. 1. The metal coaxial line 26 allows TM11 mode to be generated in the circular waveguide 22, and as a result, the circular waveguide 22 has grater cut-off wavelength than the circular waveguide 12. The flared conical portion 23 has greater inner diameter as approaching an aperture 24. The metal coaxial line 26 protrudes by length "C" from the boundary line between the circular waveguide 22 and the flared conical portion 23.

It is difficult to make a conventional horn antenna compact due to the flared portion provided therein.

In addition, it is known in the art of plasma generation apparatuses a slot antenna for radiating microwave with a center conductor being protruded.

[Patent Document 1] Japanese Laid-open Patent Publication No. 11-284428

[Patent Document 2] Japanese Laid-open Patent Publication No. 2004-266268

SUMMARY

According to an aspect of the invention, an aperture antenna includes an outer conductor with substantially fixed inner diameter; and an inner conductor, an end thereof receding from an aperture of the outer conductor in a direction of electromagnetic radiation.

According to another aspect of the invention, an allay antenna including a plurality of aperture antennas, at least one of the plurality of aperture antennas including: an outer conductor with substantially fixed inner diameter; and an inner conductor, an end thereof receding from an aperture of the outer conductor in a direction of electromagnetic radiation.

According to yet another aspect of the invention, an electric field probe, includes: an outer conductor with substantially fixed inner diameter; and an inner conductor, an end thereof being back away from an aperture of the outer conductor in a direction of electromagnetic radiation.

According to yet another aspect of the invention, a method of adjusting an aperture antenna, the aperture antenna including an outer conductor and an inner conductor, an end thereof receding from an aperture of the outer conductor in a direction of electromagnetic radiation, the method includes: adjusting length of the outer conductor by sliding a slidable unit in a direction of electromagnetic radiation.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
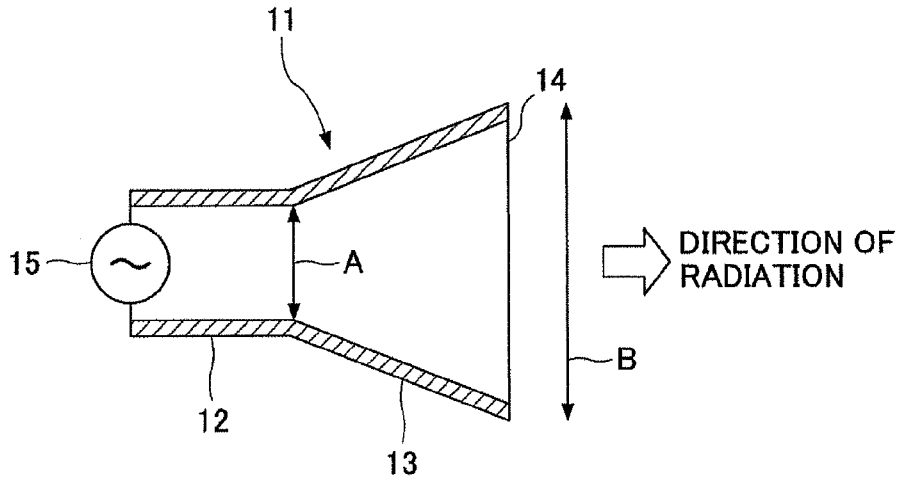
FIG.1 RELATED ART
FIG. 1 illustrates a conventional horn antenna.
Figure 2:
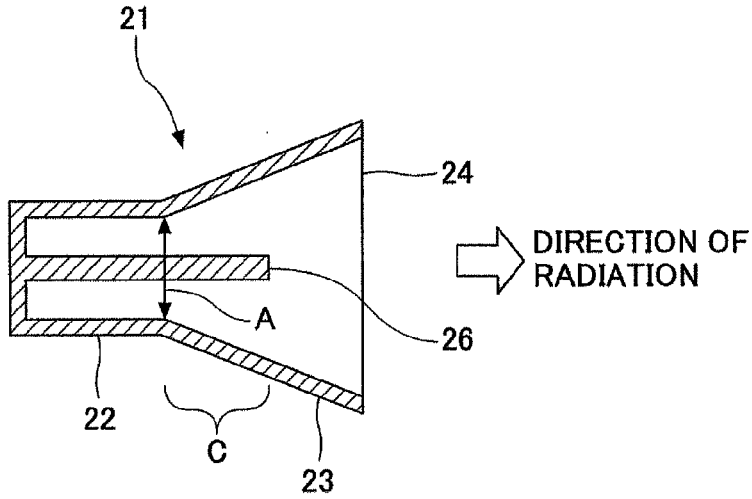
FIG.2 RELATED ART
FIG. 2 illustrates another conventional horn antenna.

Embodiments of the present invention are described in detail with reference to accompanied drawings. The same or corresponding components have a similar reference numeral throughout the drawings.

Figure 3:
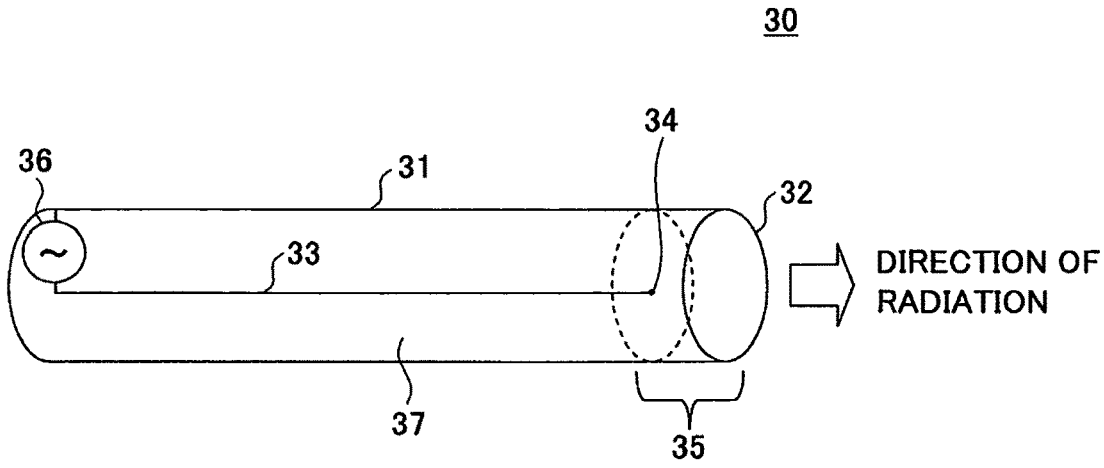
FIG. 3 illustrates an aperture antenna according to an embodiment.

FIG. 3 illustrates an aperture antenna 30 according to an embodiment. The aperture antenna 30 illustrated in FIG. 3 may include an outer conductor 31 and an inner conductor 33.

The outer conductor 31 may be made of conducting material and is shaped substantially as a circular cylinder. An example of the conducting material may include, but not limited to, metal such as copper, aluminum and brass. The outer conductor 31 has an aperture 32. The inner diameter of the outer conductor 31 is substantially fixed in the direction of its length (direction of radiation of electromagnetic waves). In other words, the outer conductor 31 does not have a flared portion provided in a conventional horn antenna. The outer diameter of the outer conductor 31 may also be substantially fixed in the direction of its length (direction of radiation of electromagnetic waves). The inner diameter of the outer conductor 31 may be shorter than the cut-off wavelength of the outer conductor 31 as a waveguide (that is, the cut-off wavelength of a waveguide of the same inner diameter as the outer conductor 31). This is because the outer conductor 31 and the inner conductor 33 form coaxial structure.

Similarly, the inner conductor 33 may be made of conducting material and is shaped substantially as a circular cylinder, in which the outer diameter thereof is shorter than the inner diameter of the outer conductor 31. An example of the conducting material may include, but not limited to, metal such as copper, aluminum and brass. The inner conductor 33 is positioned substantially at the center of the outer conductor 31, and the outer diameter of the inner conductor 33 may be fixed in the direction of its length (direction of radiation of electromagnetic waves). An end 34 of the inner conductor 33 may recede from the aperture 32 of the outer conductor 31 in the direction of radiation of electromagnetic waves.

Receding of the end 34 of the inner conductor 33 from the aperture 32 of the outer conductor 31 forms an impedance matching region 35 between the end 34 of the inner conductor 33 and the aperture 32 of the outer conductor 31. The length of the impedance matching region 35 in the direction of radiation will be discussed in detail with respect to FIGS. 7 and 8.

An oscillation source 36 is connected between the outer conductor 31 and the inner conductor 33 of the aperture antenna 30 to supply electromagnetic waves to be radiated through the aperture antenna 30.

The inner conductor 33 may be supported in the outer conductor 31 by filling dielectric material (hereinafter may be referred to as dielectric part 37) such as polyethylene and fluorine resin between the outer conductor 31 and the inner conductor 33. The dielectric part 37 will be discussed below in more detail with respect to FIG. 15.

The performance of the aperture antenna 30 is now described.

Figure 4:
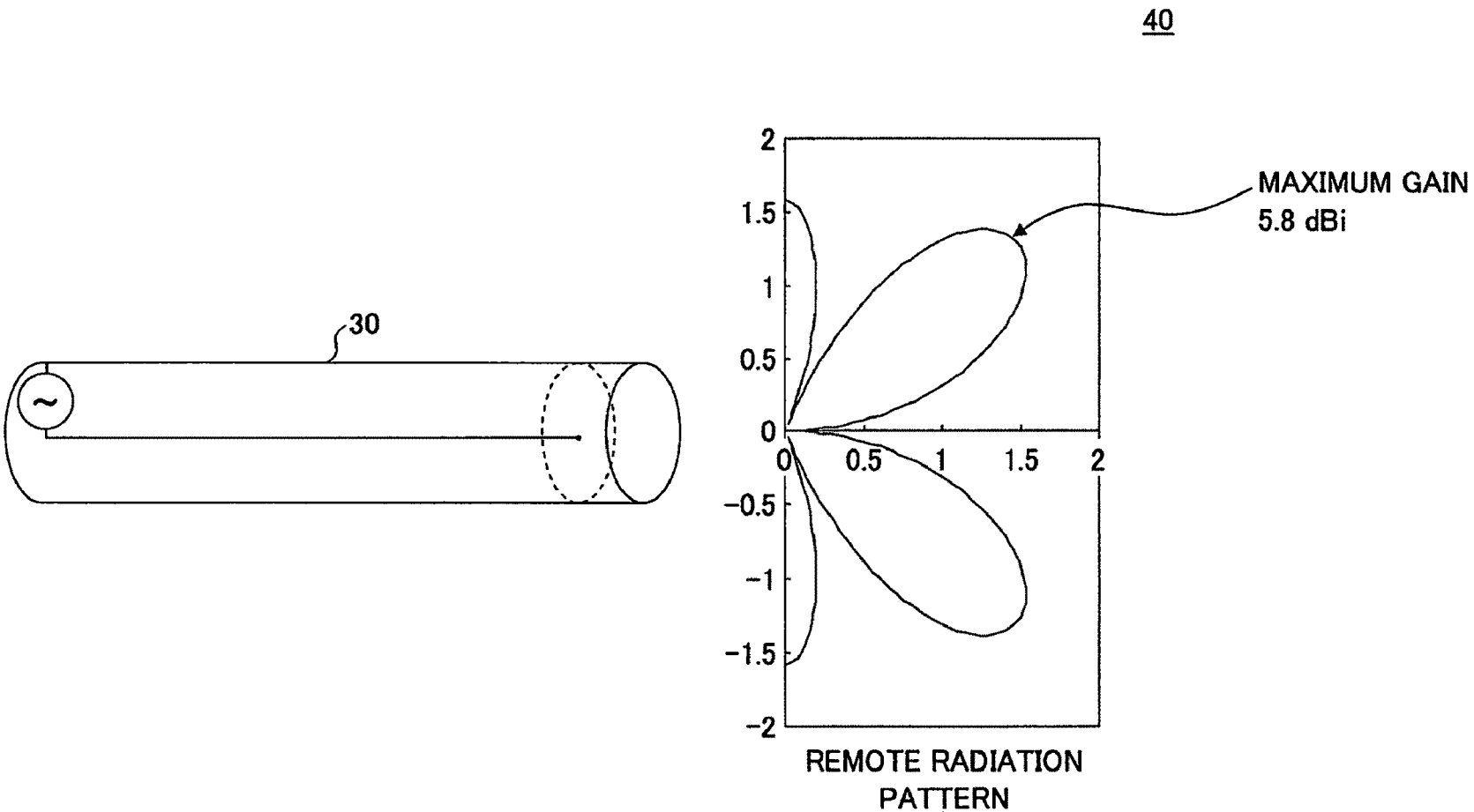
FIG. 4 illustrates remote radiation pattern of the aperture antenna illustrated in FIG. 3.

FIG. 4 illustrates remote radiation pattern of the aperture antenna 30 illustrated in FIG. 3. The remote radiation pattern for the aperture antenna 30 is computed based on the following conditions: the inner diameter of the outer conductor 30 mm; the (outer) diameter of inner conductor 1.5 mm; the length of the impedance matching region in the direction of radiation 30 mm; the frequency of electromagnetic waves to be radiated 950 MHz. Unless otherwise specified, computation and/or simulation to be described below are made under the same conditions. The remote radiation pattern 40 illustrated in FIG. 4 has the maximum gain 5.8 dBi, which is good for an aperture antenna with relatively small area of aperture.

Figure 5:
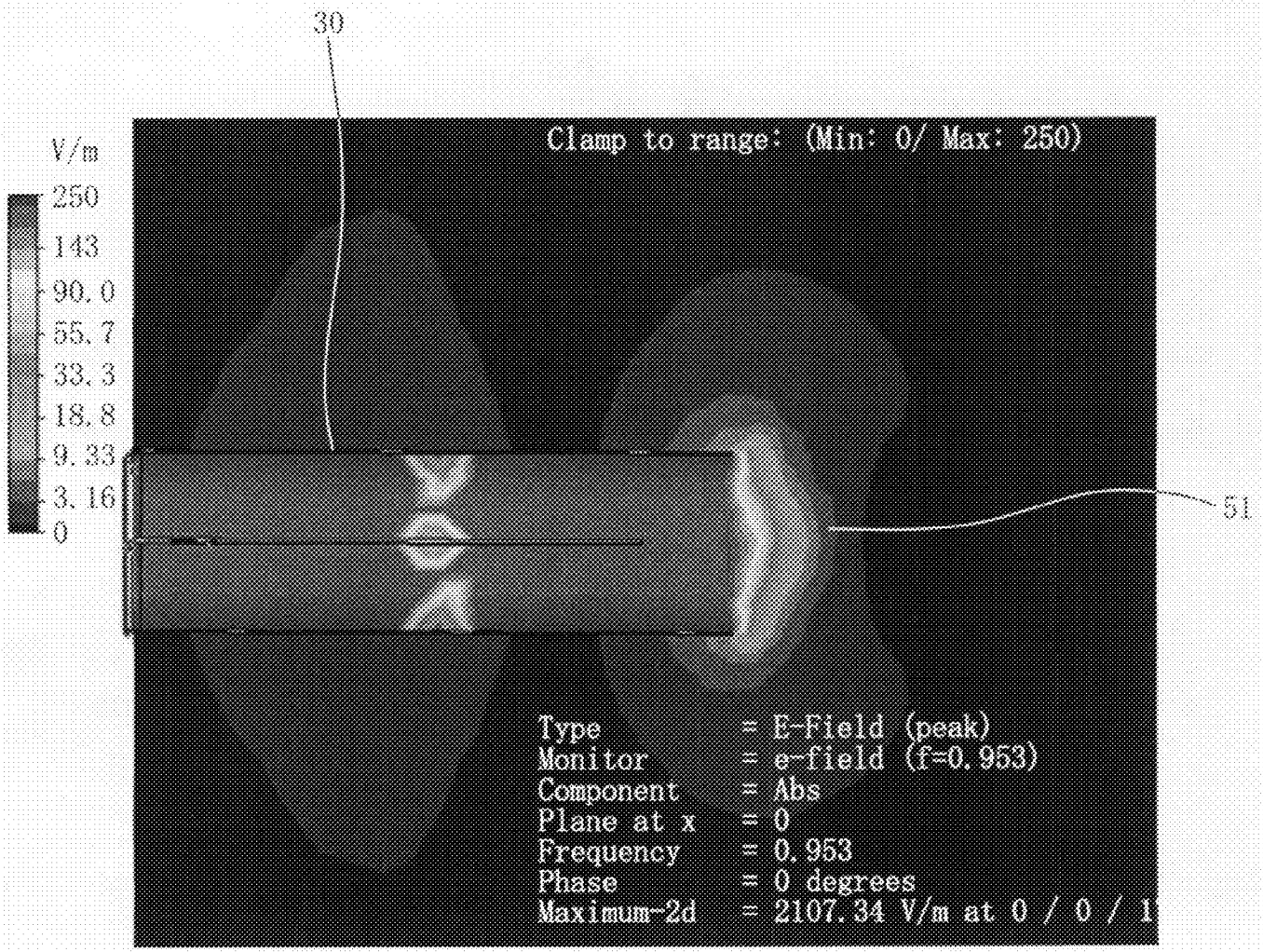
FIG. 5 illustrates neighborhood distribution of electric field of the aperture antenna illustrated in FIG. 3.

FIG. 5 illustrates neighborhood distribution of electric field of the aperture antenna 30 illustrated in FIG. 3. FIG. 5 illustrates the case in which a 1 Volt sine wave is applied with the remaining condition remaining the same as FIG. 4. It is seen that the neighborhood electric field 51 output from the aperture antenna 30 is convex. This suggests that the aperture antenna 30 may be used as a high-resolution electric field probe of small diameter.

Figure 6:
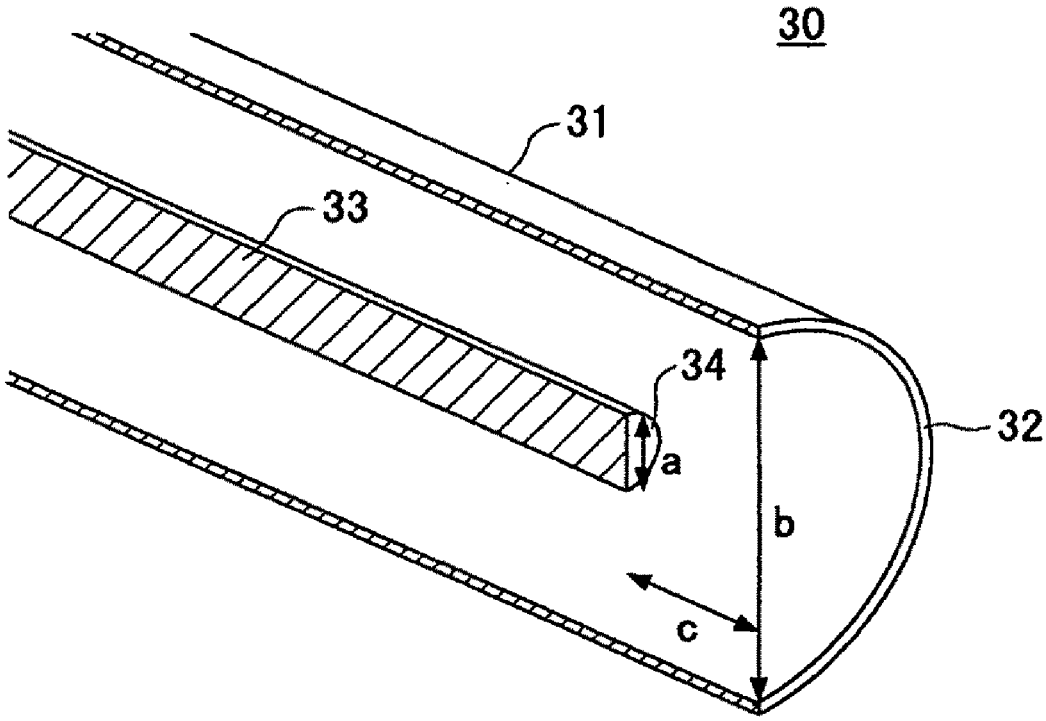
FIG. 6 is a perspective sectional view of the aperture antenna illustrated in FIG. 3.
Figure 7:
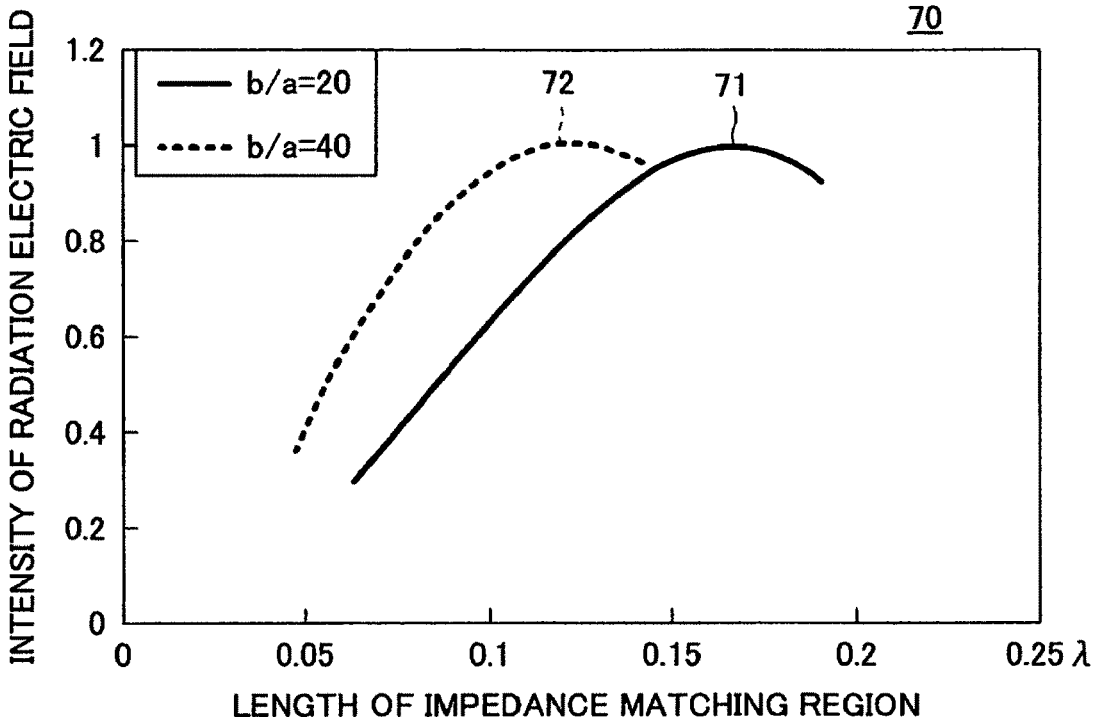
FIG. 7 is a graph indicating the relation between the intensity of radiation electric field and the length of impedance matching region.
Figure 8:
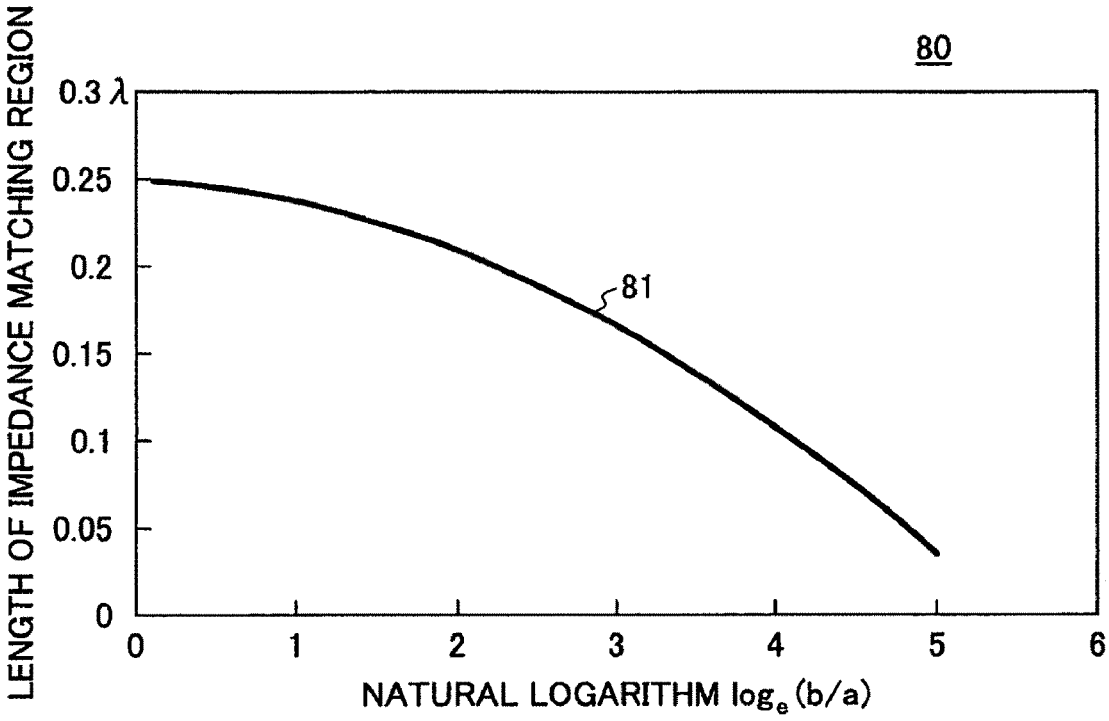
FIG. 8 is a graph indicating the optimal length of impedance matching region.

The dimension of the impedance matching region is now described in detail with respect to FIGS. 6-8. Reference is made to FIG. 6 first. FIG. 6 is a perspective sectional view of the aperture antenna 30 illustrated in FIG. 3. As illustrated in FIG. 6, "b" indicates the inner diameter of the outer conductor 31; "a" indicates the outer diameter of the inner conductor 33, and "c" indicates the distance by which the end 34 of the inner conductor 33 recedes from the aperture 32 of the outer conductor 31, which is the length of the impedance matching region.

FIG. 7 illustrates the intensity of radiation electric field as a function of the length "c" of the impedance matching region for different values of b/a. In a graph 70 illustrated in FIG. 7, the abscissa axis represents the length "c" of the impedance matching region which is normalized by the wavelength lambda of electromagnetic wave. The axis of ordinate represents the intensity of radiation electric field which is normalized by its maximum value. A curve 71 represents the intensity of radiation electric field in the case of b/a=20, and another curve 72 represents the case of b/a=40. It is understood from FIG. 7 that, the greater the ratio b/a of an impedance matching filed is, that is, the longer the inner diameter "b" of the outer conductor 31 is with respect to the outer diameter "a" of the inner conductor 33, the shorter the length of the impedance matching field is at which the maximum intensity of radiation electric field is achieved. The curve 71 achieves its maximum approximately at c=0.18*lambda, and the curve 72 at c=0.12*lambda.

Consequently, FIG. 8 is obtained which illustrates a particular length "c" of the impedance matching region that achieves the maximum intensity of radiation electric field as a function of parameter b/a. The particular length "c" may be referred to as the optimal length of impedance matching region. In a graph 80 illustrated in FIG. 8, the abscissa axis b/a represents the natural logarithm $\log_e(b/a)$ and the axis of ordinate represents the optimal length of impedance matching region which is normalized by the wavelength lambda of the electromagnetic waves. A curve 81 depicted in FIG. 8 indicates that the optimal length "c" of the impedance matching region approaches approximately to 0.25 as $\log_e(b/a)$ approaches zero, that is, the outer diameter of the inner conductor 33 is increased with respect to the inner diameter of the outer conductor 31. In addition, the curve 81 further indicates that the optimal length "c" of the impedance matching region approaches zero as $\log_e(b/a)$ is increased, that is, the inner diameter of the outer conductor 31 is reduced with respect to the outer diameter of the inner conductor 33. The curve 81 illustrated in FIG. 8 can be approximated by the following second order polynomial:

$$c=-7.5*10^{-3}x^2-6.25*10^{-3}x+0.25 \quad (1)$$

where "x" represents the natural logarithm of the ratio b/a, or $x=\log_e(b/a)$.

Figure 9:
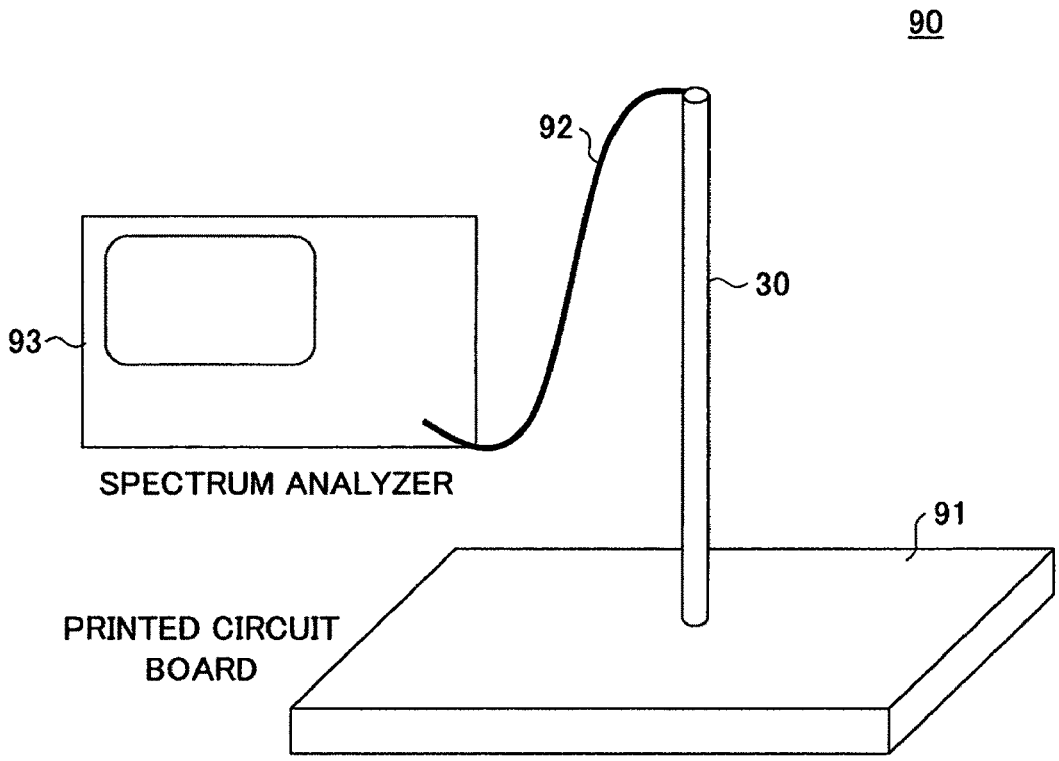
FIG. 9 illustrates an exemplary electric field probe using an aperture antenna according to an embodiment.

FIG. 9 illustrates an exemplary electric field probe using an aperture antenna according to an embodiment. An electric field measurement system 90 illustrated in FIG. 9 includes an aperture antenna 30 as an electric field probe and a spectrum analyzer 93, both connected via a cable 92. The aperture antenna 30 may be positioned near a printed circuit board (PCB) 91 to be measured, with its aperture facing the PCB 91, and capture an electric field leaking from wiring printed on the PCB 91, which allows the spectrum analyzer 93 to measure signals flowing through the wiring. The electric field measurement system according to the present embodiment may allow electric field to be measured with high positional resolution than a system using a conventional antenna as an electric field probe.

Figure 10:
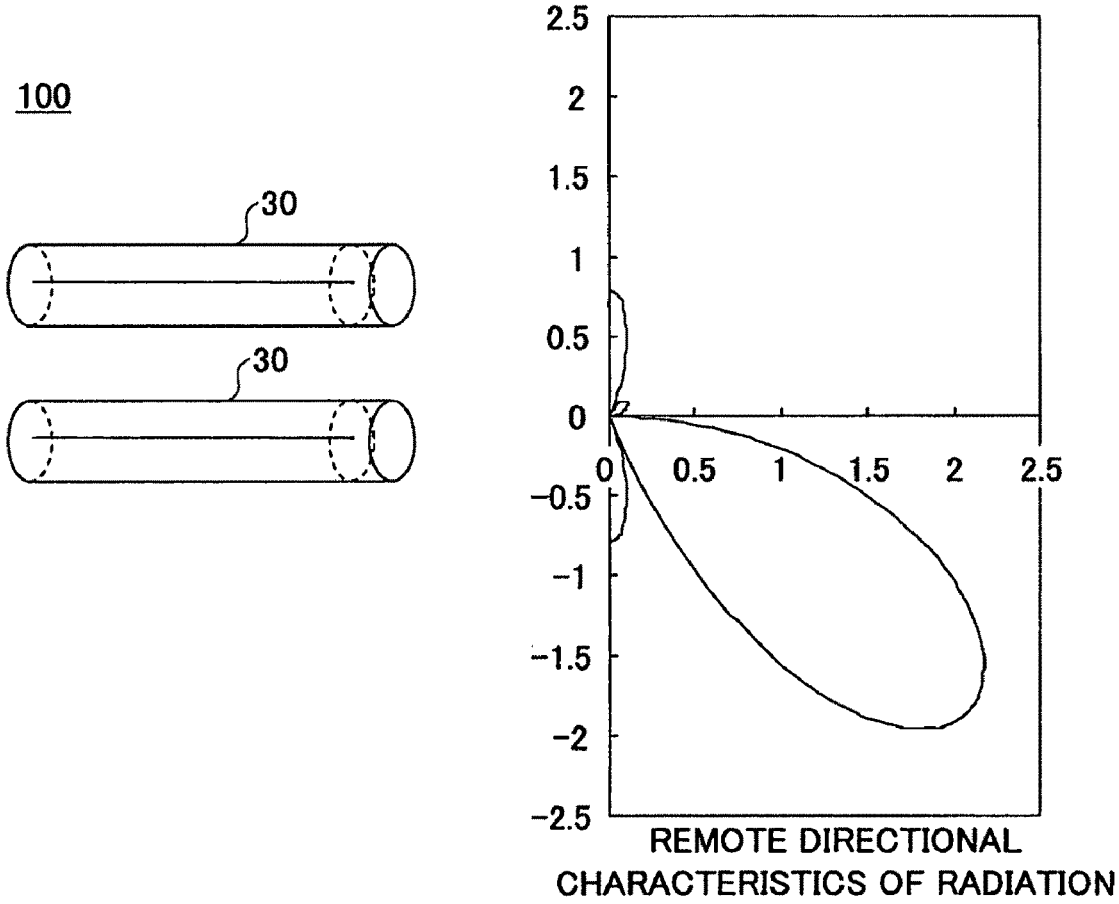
FIG. 10 illustrates an exemplary allay antenna using multiple aperture antennas according to an embodiment.

FIG. 10 illustrates an exemplary allay antenna using multiple aperture antennas according to an embodiment. The allay antenna 100 illustrated in FIG. 10 includes multiple (two, in this case) aperture antennas 30. The two aperture antennas 30 are placed approximately 15 mm apart from each other. In theory, the gain of multiple aperture antennas is proportional to the aggregate area of apertures, and the allay antenna 100 has comparable gain to a horn antenna of the same aperture area. In addition, the allay antenna 100 can provide a variety of radiation patterns by adjusting the amplitude and phase of electromagnetic waves supplied to each aperture antenna 30. The alley antenna 100 may provide more flexibility in antenna design than conventional aperture antennas. The remote radiation pattern of FIG. 10 illustrates the case in which the two aperture antennas 30 being provided with oscillation of the same amplitude and different phases by 90 degree. If the phases of the oscillations supplied to the two aperture antennas 30 are reversed, an opposite (upside down) remote radiation pattern to that illustrated in FIG. 10 is available. Thus, the allay antenna according to the present embodiment may provide for high design flexibility, while a single horn antenna only has a fixed radiation pattern and provide for low design flexibility.

Figure 11:
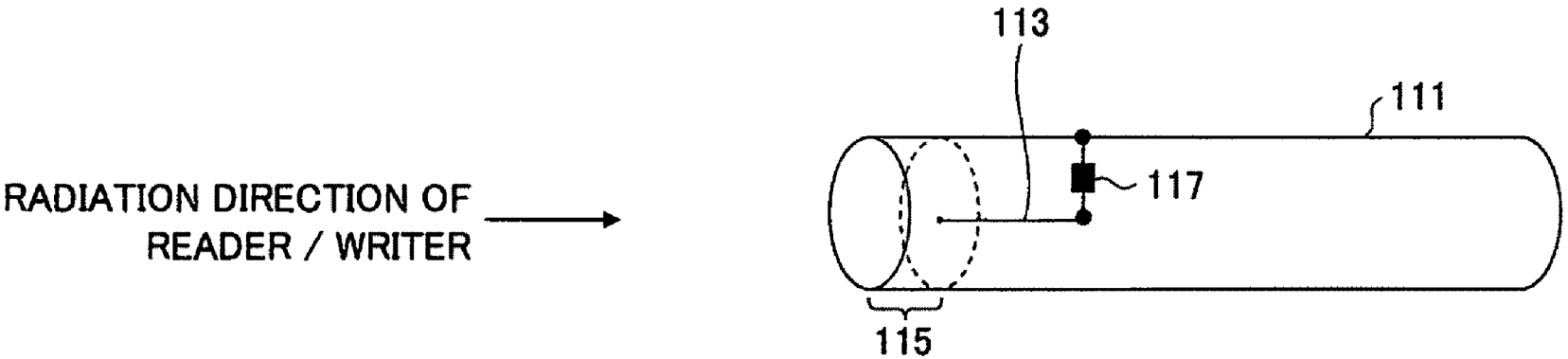
FIG. 11 illustrates a metal pipe RF tag using an aperture antenna according to an embodiment.

The case in which a radio frequency (RF) tag is provided to a metal pipe is now described as an exemplary application of the aperture antenna 30. It is assumed that multiple metal pipes which may be piled up needs to be marked with RF tags. Taking it into consideration that electromagnetic waves may be reflected by a metal pipe, an RF tag may need to be provided in the metal pipe. However, an electromagnetic wave from an RF tag reader/writer to read or write information to the RF tag may not go into the metal pipe to arrive at the RF tag if the wavelength of the electromagnetic wave is longer than the cut-off wavelength of the metal pipe. In such a case, the aperture antenna 30 according to the embodiment may be applicable. FIG. 11 illustrates a metal pipe RF tag using an aperture antenna according to an embodiment. A tag circuit 117 is provided inside a metal pipe 111 as illustrated in FIG. 11. The tag circuit 117 is provided with a conductive pin 113 facing the aperture of the metal pipe 111. The conductive pin 113 recedes from the aperture of the metal pipe 111 in the direction of electromagnetic waves from the RF tag reader/writer (not shown) to form an impedance matching region 115.

Figure 12:
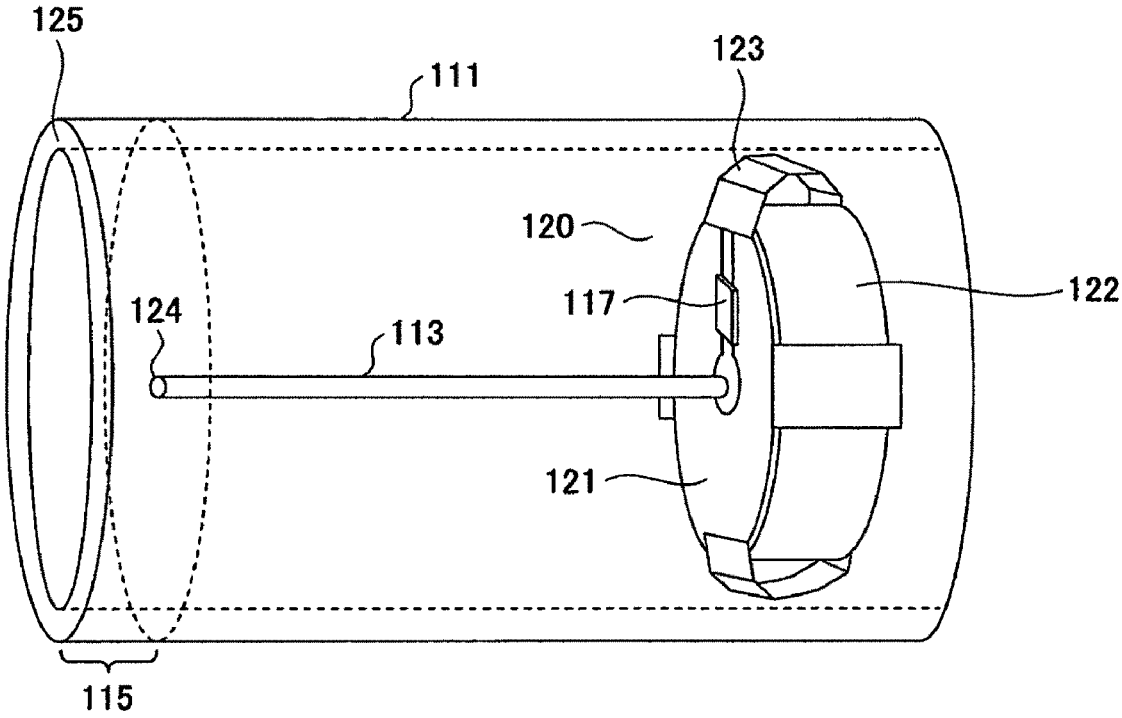
FIG. 12 illustrates the RF tag circuit of FIG. 11 in more detail.

FIG. 12 illustrates the RF tag circuit portion of FIG. 11 in more detail. The RF tag circuit portion 120 illustrated in FIG. 12 includes a tag substrate 121 on which the tag circuit 117 is mounted. Substantially at the center of the tag substrate 121, there is the conductive pin 113 (of 1.5 mm diameter, for example) standing substantially perpendicular to the tag substrate 121. The tag substrate 121 has a thickness member 122 to increase the thickness of the RF tag circuit portion 120 as well as multiple (four in this case) support members 123. The RF tag circuit portion 120 is inserted into the metal pipe 111 and supported by the multiple support members 123 in the metal pipe 111. The end 124 of the conductive pin 113 opposite to the tag substrate 121 recedes from the aperture 125 of the metal pipe 111, which forms the impedance matching region 115.

Figure 13A:
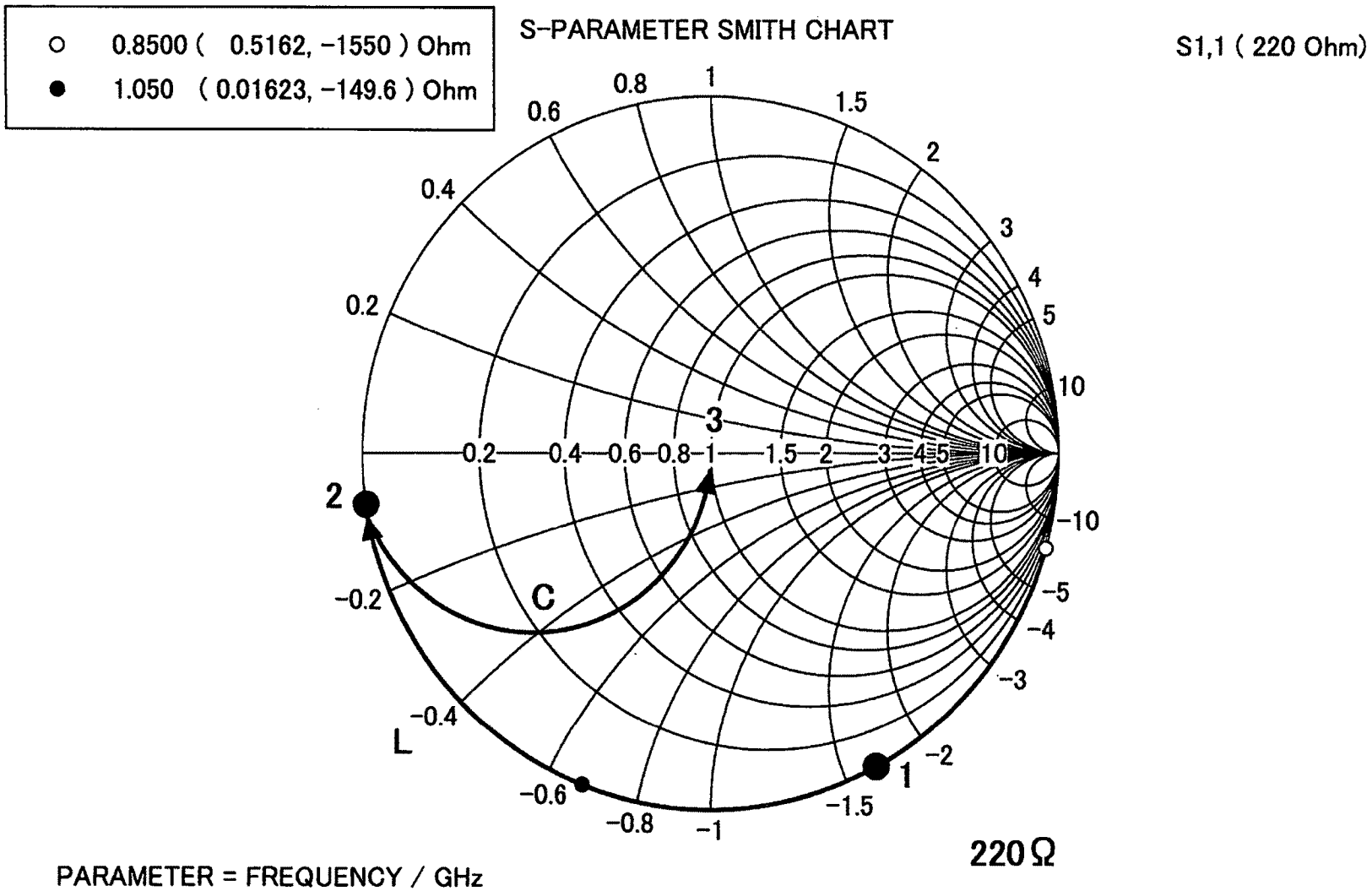
FIGS. 13A-13C illustrate matching methods of an aperture antenna at an oscillation source side according to an embodiment.
Figure 13B:
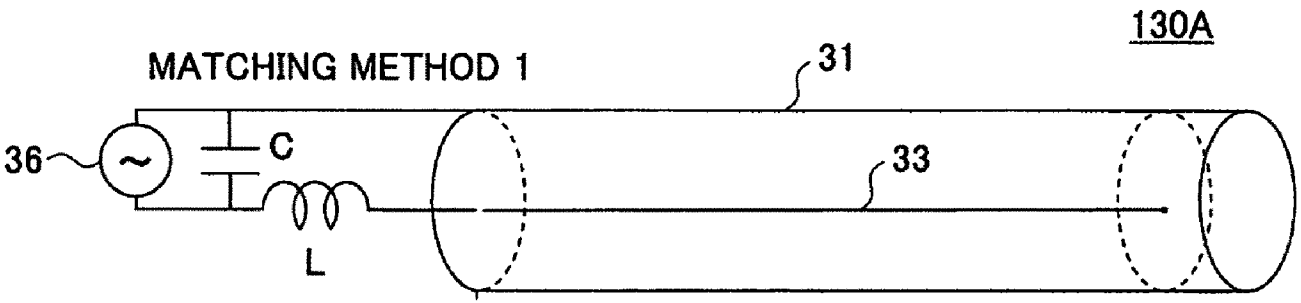
Figure 13C:
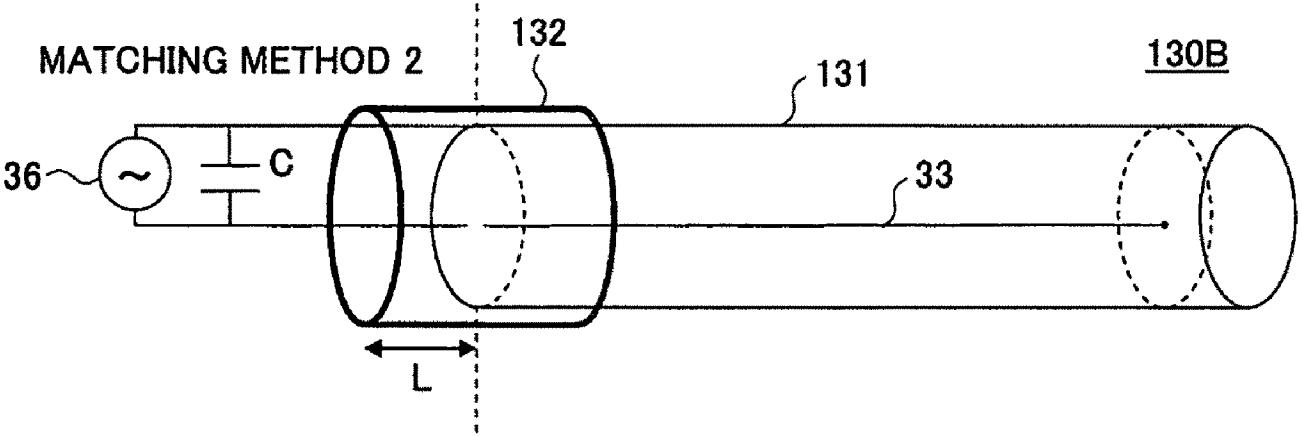

FIGS. 13A and 13B illustrate a matching method of an aperture antenna at an oscillation source side according to an embodiment. In the matching method 1 for an aperture antenna 130A illustrated in FIG. 13B, between the outer conductor 31 and the inner conductor 33, there is provided a capacitor C in parallel with an oscillation source 36, and an inductor L in series with the parallely provided oscillation source 36 and capacitor C for impedance matching at the oscillator side. As depicted in a Smith chart illustrated in FIG. 13A, the impedance matching in this case can be achieved by adjusting the inductor L from point 1 to point 2, and then adjusting the capacitor C from the point 2 to point 3. The matching method 2 illustrated in FIG. 13C is a variation of the matching method 1 illustrated in FIG. 13B. An aperture antenna 130B has, instead of the inductor L, a slidable unit 132 that can slide in the direction of antenna length for impedance matching at the oscillator side by sliding the slidable unit 132 to adjust the length of outer conductor (including a fixed outer conductor 131 and the slidable unit 132). The impedance matching at the oscillator side can be achieved through either matching method.

Figure 14:
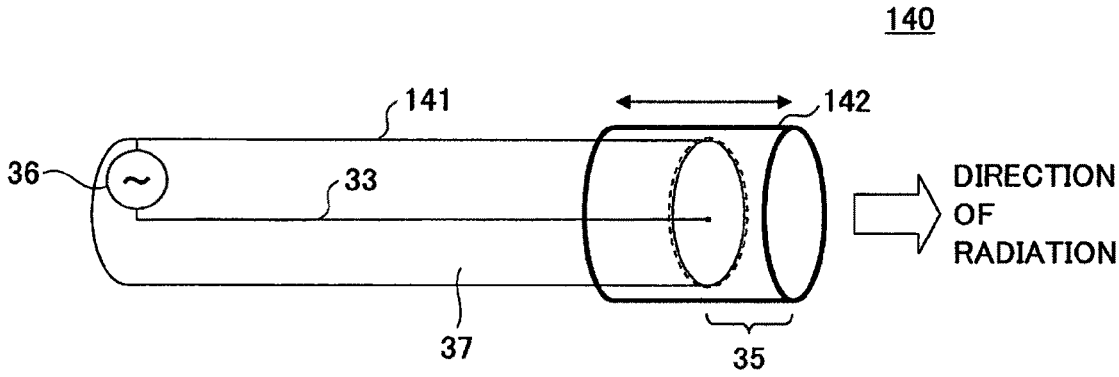
FIG. 14 illustrates a matching method of an aperture antenna at space side according to an embodiment.

FIG. 14 illustrates a matching method of an aperture antenna at space side according to an embodiment. An aperture antenna 140 illustrated in FIG. 14 has a slidable unit 142 that can slide on an outer conductor 141 in the direction of antenna length. The impedance matching can be achieved by sliding the slidable unit 142 to adjust the length of the outer conductor (including the fixed outer conductor 141 and the slidable unit 142) at the space side of the aperture antenna 140. The impedance matching at the space side of the aperture antenna 140 can be achieved by the above matching method.

Figure 15B:
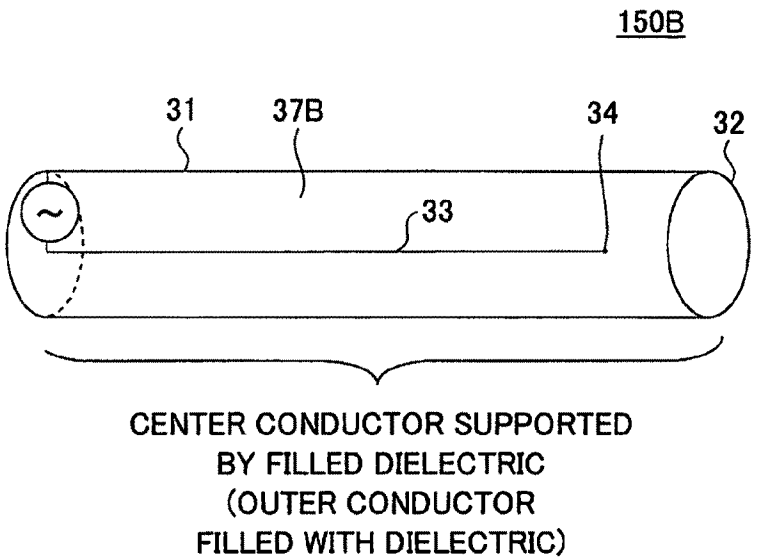
FIGS. 15A and 15B illustrate variations of dielectric part of an aperture antenna according to an embodiment.
Figure 15A:
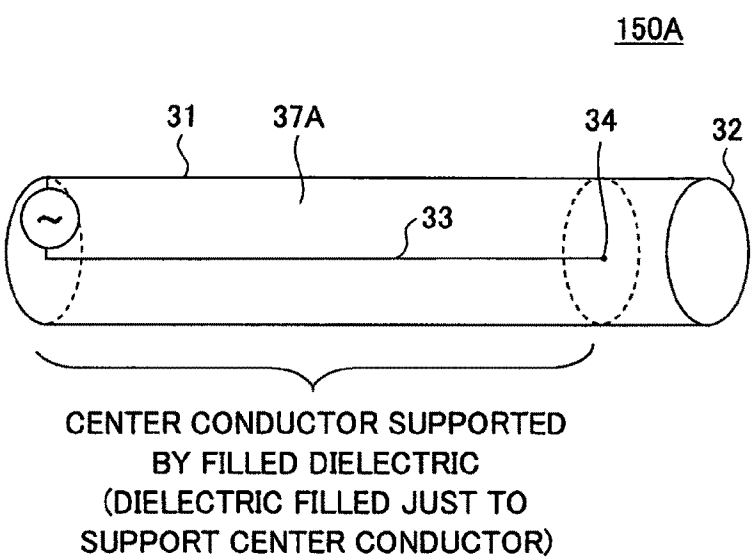

FIGS. 15A and 15B illustrate variations of dielectric part of an aperture antenna according to an embodiment. As for the aperture antenna 150A illustrated in FIG. 15A, the outer conductor 31 is filled with dielectric material (dielectric member 37A) to support the inner conductor 33. The dielectric member 37A only fills the outer conductor 31 up to the end 34 of the inner conductor 33, and no dielectric material fills a region between the end 34 of the inner conductor 33 and the aperture 32 of the outer conductor 31 (that is, the impedance matching region). As for the aperture antenna 150B illustrated in FIG. 15B, the outer conductor 31 is filled with dielectric material (dielectric member 37B) to support the inner conductor 33. The dielectric member 37B fills the outer conductor 31 up to the aperture 32. The impedance matching region is also filled with the dielectric material. It would be appreciated by one with ordinary skill in the art that, since the dielectric constant of the impedance matching region is different in dependence on the existence and/or absence of dielectric material in the impedance matching region, the optimal length of the impedance matching region also depends on the existence and/or absence of dielectric material in the impedance matching region.

According to the embodiments described above, the cross-section of the outer conductor is described as circular. According to another embodiment, the cross-section of the outer conductor may be of another shape such as square, rectangular, and oval.

According to the embodiments described above, the cross-section of the inner conductor is described as circular. According to another embodiment, the cross-section of the inner conductor may be of another shape such as square, rectangular, and oval.

According to the embodiments described above, the outer conductor is filled with dielectric material to support the inner conductor. However, it should be noted that the dielectric member is optional and may not be provided depending on specific antenna design.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An aperture antenna, comprising:

an outer conductor having a substantially fixed inner diameter and an aperture on one end thereof; and an inner conductor having an end thereof receded from the aperture of the outer conductor in a longitudinal direction of the outer conductor, and wherein a length of the outer conductor along the longitudinal direction is adjustable by sliding a slidable unit in an axial direction.

2. The aperture antenna as claimed in claim 1, wherein a cut-off wavelength of the outer conductor is shorter than a wavelength of electromagnetic radiation.

3. The aperture antenna as claimed in claim 1, wherein a distance c by which the end of the inner conductor is receded from the aperture of the outer conductor satisfies 0.12*lambda<=c<=0.18*lambda, where "a" represents an outer diameter of the inner conductor, "b" represents an inner diameter of the outer conductor, "lambda" represents a wavelength of electromagnetic radiation, and 20<=b/a<=40.

4. The aperture antenna as claimed in claim 1, wherein $c=-7.5*10^{-3}x^2-6.25*10^{-3}x+0.25$ where "c" represents a distance by which the end of the inner conductor is receded from the aperture of the outer conductor, and "x" represents a natural logarithm of a ratio b/a, or $x=\log_e(b/a)$, where "a" represents an outer diameter of the inner conductor, and "b" represents the inner diameter of the outer conductor.

5. The aperture antenna as claimed in claim 1, wherein a cross-section of the outer conductor along a direction perpendicular to the longitudinal direction is substantially circular.

6. The aperture antenna as claimed in claim 1, wherein a cross-section of the inner conductor along a direction perpendicular to the longitudinal direction is substantially circular.

7. The aperture antenna as claimed in claim 1, wherein a diameter of the inner conductor is substantially constant.

8. The aperture antenna as claimed in claim 1, wherein the inner conductor is positioned substantially at a center of the outer conductor.

9. The aperture antenna as claimed in claim 1, comprising a dielectric member interposed between the outer conductor and the inner conductor.

10. The aperture antenna as claimed in claim 1, comprising:

a matching part configured to perform an impedance matching between the aperture antenna and space.

11. The aperture antenna as claimed in claim 1, comprising:

a matching part configured to perform an impedance matching between the aperture antenna and an oscillation source.

12. The aperture antenna as claimed in claim 1, comprising:

a radio frequency tag provided within the outer conductor.

13. The aperture antenna as claimed in claim 12, wherein the inner conductor extends from the radio frequency tag towards the aperture.

14. The aperture antenna as claimed in claim 1, wherein a gap is formed between an outer peripheral surface of the inner conductor and an inner peripheral surface of the outer conductor.

15. The aperture antenna as claimed in claim 1, wherein the longitudinal direction is substantially parallel to a direction of electromagnetic radiation.

16. A method of adjusting an aperture antenna, the aperture antenna comprising an outer conductor and an inner conductor having an end thereof receded from an aperture of the outer conductor in a direction of electromagnetic radiation, the method comprising:

adjusting a length of the outer conductor by sliding a slidable unit in the direction of electromagnetic radiation.

17. The method as claimed in claim 16, wherein the adjusting includes sliding the slidable unit to adjust a distance by which the end of the inner conductor is receded from the aperture of the outer conductor for impedance matching between the aperture antenna and space.

18. The method as claimed in claim 16, wherein the adjusting includes sliding the slidable unit to adjust the length of the outer conductor for impedance matching between the aperture antenna and an oscillation source.

* * * * *